US009975028B2

(12) United States Patent
Adams, Jr.

(10) Patent No.: US 9,975,028 B2
(45) Date of Patent: May 22, 2018

(54) THERAPEUTIC STRIKING AND REHABILITATION TRAINING SYSTEM

(71) Applicant: Charles D. Adams, Jr., Mount Clemens, MI (US)

(72) Inventor: Charles D. Adams, Jr., Mount Clemens, MI (US)

( * ) Notice: Subject to any disclaimer, the term of this patent is extended or adjusted under 35 U.S.C. 154(b) by 0 days. days.

(21) Appl. No.: 14/929,638

(22) Filed: Nov. 2, 2015

(65) Prior Publication Data

US 2016/0166910 A1 Jun. 16, 2016

Related U.S. Application Data

(60) Provisional application No. 62/090,054, filed on Dec. 10, 2014.

(51) Int. Cl.

| | |
|---|---|
| ***A63B 69/20*** | (2006.01) |
| ***A63B 67/10*** | (2006.01) |
| *A63B 71/00* | (2006.01) |
| *A63B 26/00* | (2006.01) |
| *A63B 22/00* | (2006.01) |

(52) U.S. Cl.

CPC ..... *A63B 69/205* (2013.01); *A63B 67/10* (2013.01); *A63B 26/003* (2013.01); *A63B 71/0009* (2013.01); *A63B 2022/0092* (2013.01); *A63B 2071/0063* (2013.01); *A63B 2225/093* (2013.01)

(58) Field of Classification Search

CPC ..... A63B 69/205; A63B 69/0079; A63B 69/0097; A63B 69/0084; A63B 69/0073; A63B 69/0075; A63B 67/10; A63B 43/007

USPC .... 473/595, 423, 426, 430, 575; 482/83, 86, 482/87, 89

See application file for complete search history.

(56) References Cited

U.S. PATENT DOCUMENTS

| | | | | |
|---|---|---|---|---|
| 445,747 A * | 2/1891 | Cook | A63B 69/201 | 482/86 |
| 740,160 A * | 9/1903 | Mills | G07F 17/14 | 194/283 |
| 3,366,383 A * | 1/1968 | Lentine | A63B 69/0079 | 473/430 |
| 3,829,093 A * | 8/1974 | Abrams | A63B 21/1627 | 473/575 |

(Continued)

FOREIGN PATENT DOCUMENTS

| | | | |
|---|---|---|---|
| DE | 2508922 A1 * | 9/1976 | A63B 69/0079 |
| FR | 1063048 A * | 4/1954 | A63B 43/007 |

*Primary Examiner* — Gregory Winter

(74) *Attorney, Agent, or Firm* — Gerald R. Black, Esq.

(57) ABSTRACT

A therapeutic striking and rehabilitation training system that provides rehabilitation and therapeutic training in a home environment for persons with disabilities from an accident, wounded veterans, from disabilities involving birth defects, or as part of a physical therapy program even for bed-ridden patients. A therapeutic striking and rehabilitation training system also improves conditioning and hand-eye coordination which is attached to a ceiling, or hung in a door opening using a bar, via a tether with a ball attached to the end of said tether. The ball is a given distance from the ceiling as determined by the user. Once the desired distance has been chosen, the user then strikes the ball with enough force for the ball to contact the ceiling and then begin a downward trajectory towards the user to be struck again.

14 Claims, 8 Drawing Sheets

(56) References Cited

U.S. PATENT DOCUMENTS

| | | | | | |
|---|---|---|---|---|---|
| 3,934,878 | A * | 1/1976 | Haber | A63B 69/0079 | 473/575 |
| 4,003,572 | A * | 1/1977 | Harvey | A63B 69/0079 | 446/220 |
| 4,248,423 | A * | 2/1981 | Lotfy | A63B 43/007 | 473/571 |
| 5,462,273 | A * | 10/1995 | Spector | A63B 41/02 | 273/DIG. 20 |
| 5,681,168 | A * | 10/1997 | Brown | A63B 69/0079 | 434/219 |
| 6,740,012 | B1 * | 5/2004 | Olszewski | A63B 69/20 | 482/83 |
| 2004/0254036 | A1 * | 12/2004 | Smith | A63B 69/0079 | 473/423 |
| 2009/0176620 | A1 * | 7/2009 | Reynolds | A63B 69/205 | 482/8 |
| 2010/0087296 | A1 * | 4/2010 | Hansen | A63B 69/205 | 482/83 |
| 2010/0311024 | A1 * | 12/2010 | Schenck | A63B 21/1681 | 434/258 |
| 2015/0105186 | A1 * | 4/2015 | Block | A63B 71/04 | 473/416 |

* cited by examiner

THERAPEUTIC STRIKING AND REHABILITATION TRAINING SYSTEM

CROSS-REFERENCE TO RELATED APPLICATIONS

This application is related to and claims priority to U.S. Provisional Application No. 62/090,054, entitled "Striking Device to Improve Conditioning and Hand-Eye Coordination" (Adams, Jr.), filed on Dec. 10, 2014.

FIELD OF USE

The present invention relates to a therapeutic and rehabilitation training system for anyone with disabilities, and more particularly, a home environment for persons with disabilities from an accident, wounded veterans, from disabilities involving birth defects, or as part of a physical therapy program even for bed-ridden patients.

BACKGROUND OF THE INVENTION

Prior approaches to workout systems utilizing tethered balls for people with disabilities are almost nonexistent and are used primarily limited to boxers and other martial arts fighters in order to improve hand-eye coordination. These apparatuses are expensive, are complex to set up at home, are rather large and not easily transported and set up, and are limited as to their applications.

U.S. Pat. No. 4,309,029 (Tomko) discloses a martial arts striking machine. The striking device for training in martial arts comprises a base and at least two arc supports of differing heights, resiliently attached in a vertical plane to the base; striking area supported on the concave side of the arc supports; adjustable spacers between the arc supports to provide variable tension levels to the arc supports; and a back brace supporting the convex side of at least one of the arc supports and at a point on the convex side so as to provide maximum stable resistance.

U.S. Pat. No. 4,077,624 (Feaser) discloses a striking device for training in martial arts. The striking device is for use by a trainee in karate, or boxing to simulate an opponent. Target elements are suspended by a cord from a fixed overhead position and pivoted rod-mounted response elements are balanced between the target elements. When the trainee strikes the target elements, the response elements move in an unpredictable manner to strike back at the trainee.

U.S. Pat. No. 4,138,107 (Janis) discloses a sports practice device for practicing the stroking motion used in games such as tennis, baseball, squash and the like includes a pair of guide rails mounted to the floor and ceiling of a room, a pair of carriages constrained to move relative to the rails between stops mounted in the rails, and a ball secured to an elastic cord which in turn is secured to the carriage members thereby suspending the ball a pre-determined distance above the floor at a hitting position. When the ball is hit, motion is imparted to the carriage members which move along the guide rails until their motion is stopped by the stops.

U.S. Pat. No. 8,118,714 (Ramsay-Matthews) discloses a portable boxing and martial arts training apparatus. The apparatus relates to a hand-eye coordination training apparatus designed for all sports enthusiasts and martial artists seeking hand speed timing and accuracy. The apparatus offers unpredictable vertical and horizontal target movement, as well as instant adjustability to change the tension and height of the target. This enables the target to travel at varied heights, speeds and distances. The apparatus is effective in isolating the skill of hand eye coordination because it provides minimal resistance.

U.S. Patent Publication No. 20100311024 (Schenck) discloses an invention uses fitness, balance, and coordination improvement methods using an adjustable swing arm(s) and swivel which will suspend attached activity specific tethers and targets. Said invention's horizontal arms can be manipulated easily and set securely. The most basic setup enables one participant to successfully hit a target more than once because target always returns to its starting point.

What is needed is a system that provides rehabilitation and therapeutic recovery training for those who need such training while also providing full body workouts and fitness training for those seeking such training.

What is needed is a system that is especially designed for visual rehabilitation, depth perception and peripheral tracking, while increasing hand-eye coordination, strength, and mobility, while improving upper body muscle tone and reducing fat.

What is needed is a training system for use in a home, made of soft lightweight foam that is essentially silent, which can be punched extremely hard, repeatedly, which will not damage the premises, which requires little space, is adjustable for users of various shapes and sizes, which promotes total body-mind involvement, which is safe, fun, and easy to learn.

It is the primary objective of the therapeutic striking and rehabilitation training system of the present invention to provide rehabilitation and therapeutic training in a home environment for persons with disabilities from an accident, wounded veterans, from disabilities involving birth defects, or as part of a physical therapy program.

It is another object of the therapeutic striking and rehabilitation training system of the present invention to enable a developmentally delayed person, or a physically or neurologically impaired person, such as a child or adult, to learn where they are in space in relation to other objects, to help them learn depth perception.

It is still yet another objective of the therapeutic striking and rehabilitation training system of the present invention is to provide a training device to be used by the user once rehabilitated as a training device for full-body workouts for hand-eye coordination training, reflex training, cross training, or simply to maintain and improve coordination of a weaker side of the user's body at home.

SUMMARY OF THE INVENTION

The therapeutic striking and rehabilitation training system addresses these objectives and needs.

The therapeutic striking and rehabilitation training system of the present invention includes a foam ball attached to the end of a cord, which is then tethered to a ceiling via a quick detach mount with the length of the tether and the height of the ball being adjustable depending on the preference of the user. The purpose of the therapeutic striking and rehabilitation training system is to help improve hand-eye coordination of a user by striking the ball hard enough until it contacts the ceiling and rebounds back towards the user, who then strikes the ball again. Since the user will not strike the ball the same way every time, the ball will come to the user, after contacting the ceiling, with a different trajectory, forcing the user to change the striking angle. If the ball is struck in a such a manner as to make it difficult to strike upon the return of the ball, the user will be able to adjust and dodge the ball and strike the ball as it swings around back toward the user. In one preferred embodiment an anchor is inserted into the ball to offset the center of mass of the ball which will occasionally alter the angle of the rebound, keeping even the most skillful user focused.

The therapeutic striking and rehabilitation training system of the present invention includes a foam ball, preferably of about 7 in. diameter, tethered from a 3/16 in. diameter braided nylon cord anchored inside the ball. The braided nylon cord is suspended from the ceiling, the foam ball hanging at approximately chin height of the user in order to punch, slap or elbow the ball repeatedly against the ceiling.

When the user is done, the system of the present invention can be left attached to the ceiling mount, or can be taken down and stored until needed again. Also, friends can challenge each other to see who can strike the ball the most times consecutively without missing.

Further, fitness instructors can use the therapeutic striking and rehabilitation training system of the present invention in their classes or with individual clients.

For a complete understanding of the therapeutic striking and rehabilitation training system of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE PREFERRED EMBODIMENTS

Figure 1:
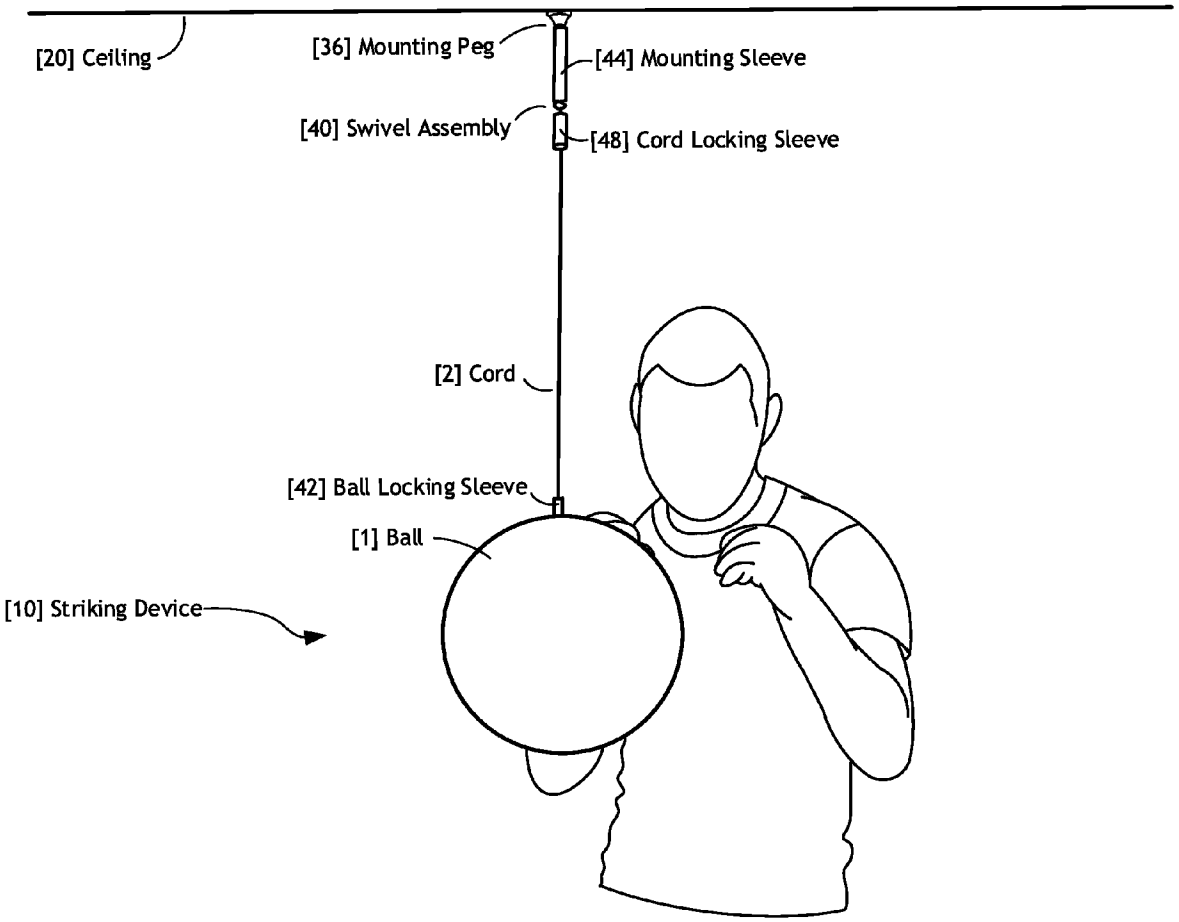
FIG. 1 depicts an individual using the perspective view of a first preferred embodiment of the therapeutic striking and rehabilitation training system of the present invention assembled and attached to the ceiling.

Referring now to the drawings, FIG. 1 depicts first preferred embodiment of the therapeutic striking and conditioning system of the present invention [10] including an individual using said device. The essential components of the system comprise a ball [1], a cord [2] tethered to the ball [1] and to a ceiling [20], a ceiling mount [36], and a ball mount [42].

The ball [1] is preferably made of elastic foam-like material made from a solid, spongy cellular material produced by the reaction of polyester with a disocyanate while carbon dioxide is liberated by the reaction of a carboxyl with the isocyanate. Polyester resin reacts with a compound while carbon dioxide is simultaneously released by another reaction. It is this gas that creates open pockets within the polyurethane that, in turn, makes the material soft and light. The ball, of choice is a 7 in. diameter foam ball—and is commercially available from POOF-Slinky as Model No. 247BL, a bright red color for contrast being preferred since it is more readily detected by people who are visually impaired, even in dim light. The ball has a soft texture and will not damage the face or body of the user if the ball strikes the user at higher speeds rebounding from the ceiling surface. The soft texture is also critical in minimizing the noise generated by the striking and the rebounding of the ball from the ceiling surface.

The cord [2] of choice is preferably about 45 in. long, white, 3/16 in., round nylon having a 3/16 in. dia. The ceiling mount or mounting peg [36] of choice is 2 in. plastic tubing having a ¼ in. internal diameter and a ½ in. outer diameter. The ball mount or ball locking sleeve [42] which is preferably ¼ in. rubber sleeve of tubing.

Figure 2:
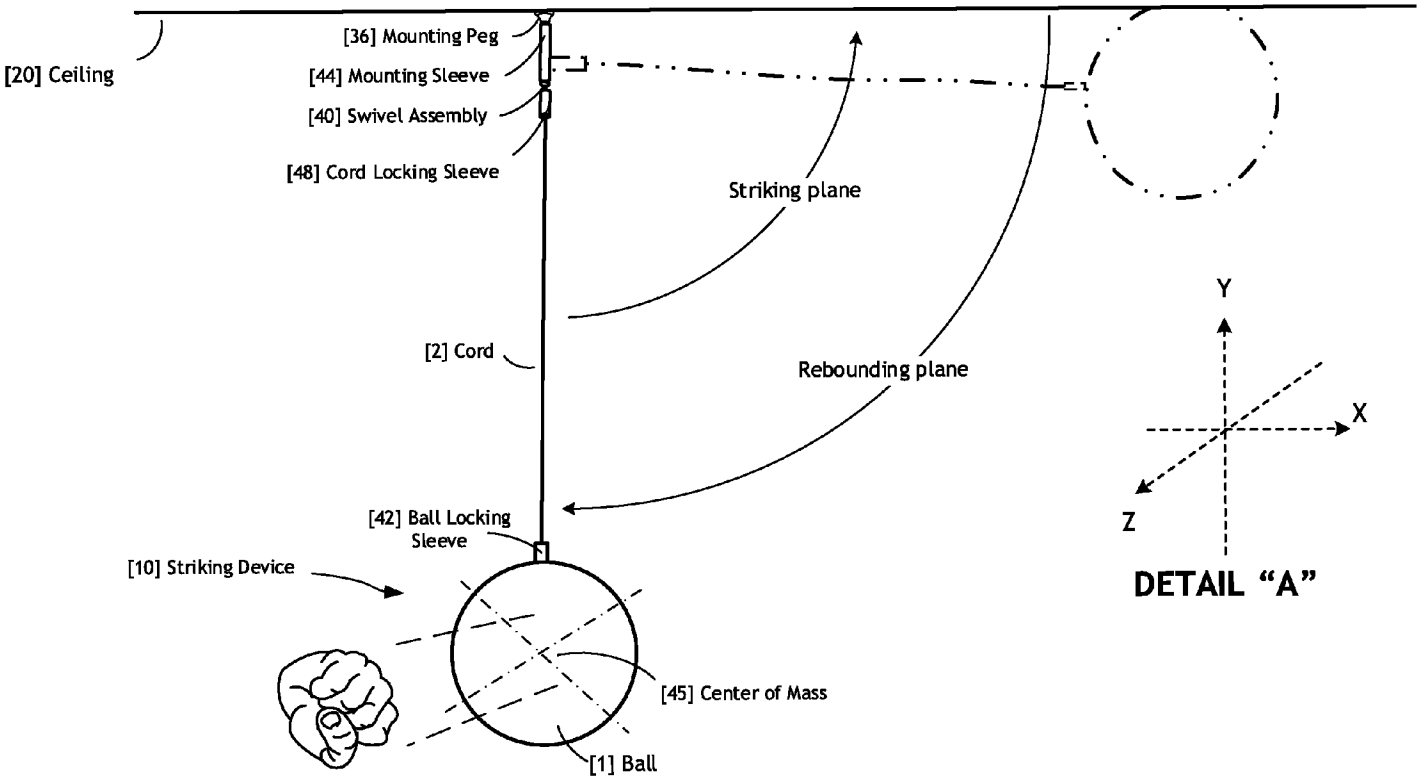
FIG. 2 depicts an end view of the therapeutic striking and rehabilitation training system of FIG. 1 assembled and attached to the ceiling; and DETAIL "A" depicts a Cartesian coordinate system for measuring the striking plane and the rebounding plane of the ball of the therapeutic striking and conditioning system of the present invention of FIG. 1.

FIG. 2 depicts the preferred embodiment of the therapeutic striking and conditioning system of the present invention [10] after the ball [1] has been struck by the user and as the ball [1] is hitting the ceiling [20]. The ½ in. mounting peg [36] is about ½ in. in size and attached to the ceiling [20], preferably via a screw [34]. The internal ball anchor [4] is attached to the nylon cord [2], with the internal ball anchor [4] inserted into the foam ball [1].

Attaching the nylon cord [2] to the internal ball anchor [4] is a cord lock [32]. The nylon cord [2] is tied to the cord lock [32] being inserted into a 1 inch length of the ball locking sleeve [42], which is preferably rubber tubing, thus ensuring the internal ball anchor [4] stays attached to the nylon cord [2]. To attach the nylon cord [2] to the mounting peg [36], the nylon cord is attached to a swivel assembly [40] which is then inserted into a 3 in. section of mounting sleeve [44], which is then attached to the mounting peg [36]. Attached to the nylon cord [2] is a the ball locking sleeve [42] which is preferably ¼ in. rubber sleeve which also serves as the cord locking sleeve [48] approximately 2 inch in length and is used to adjust the height of the ball [1]. To adjust the height, a section of the nylon cord [2] is folded and pulled through a ¼ in. rubber sleeve which serves as the cord locking sleeve [48] to the desired length. When the ball [1] is initially struck by a user's fist, the ball [1] is propelled forward and moves through along the striking plane until the ball rebounds from the ceiling [20] and travels back towards the user in the rebounding plane as depicted in FIG. 2.

DETAIL "A" depicts a Cartesian coordinate system for measuring the striking plane and the rebounding plane of the ball of the therapeutic striking and conditioning system of the present invention of FIG. 2. The user aims to strike the ball [1] at the ball's center of mass with sufficient energy to drive the ball [1] into the ceiling [20]. Upon striking the ceiling [20], the cord [20] is essentially fully extended. The ball [1] travels through a striking plane as the ball [1] is propelled into the ceiling surface. The ball [1] returns to the user and back to the initial position for an instant after each strike, enabling a skilled user to strike the ball [1] again and again, perhaps hundreds of times, the ball [1] traveling through a rebounding plane, the rebounding plane being substantially identical to the striking plane.

Figure 3:
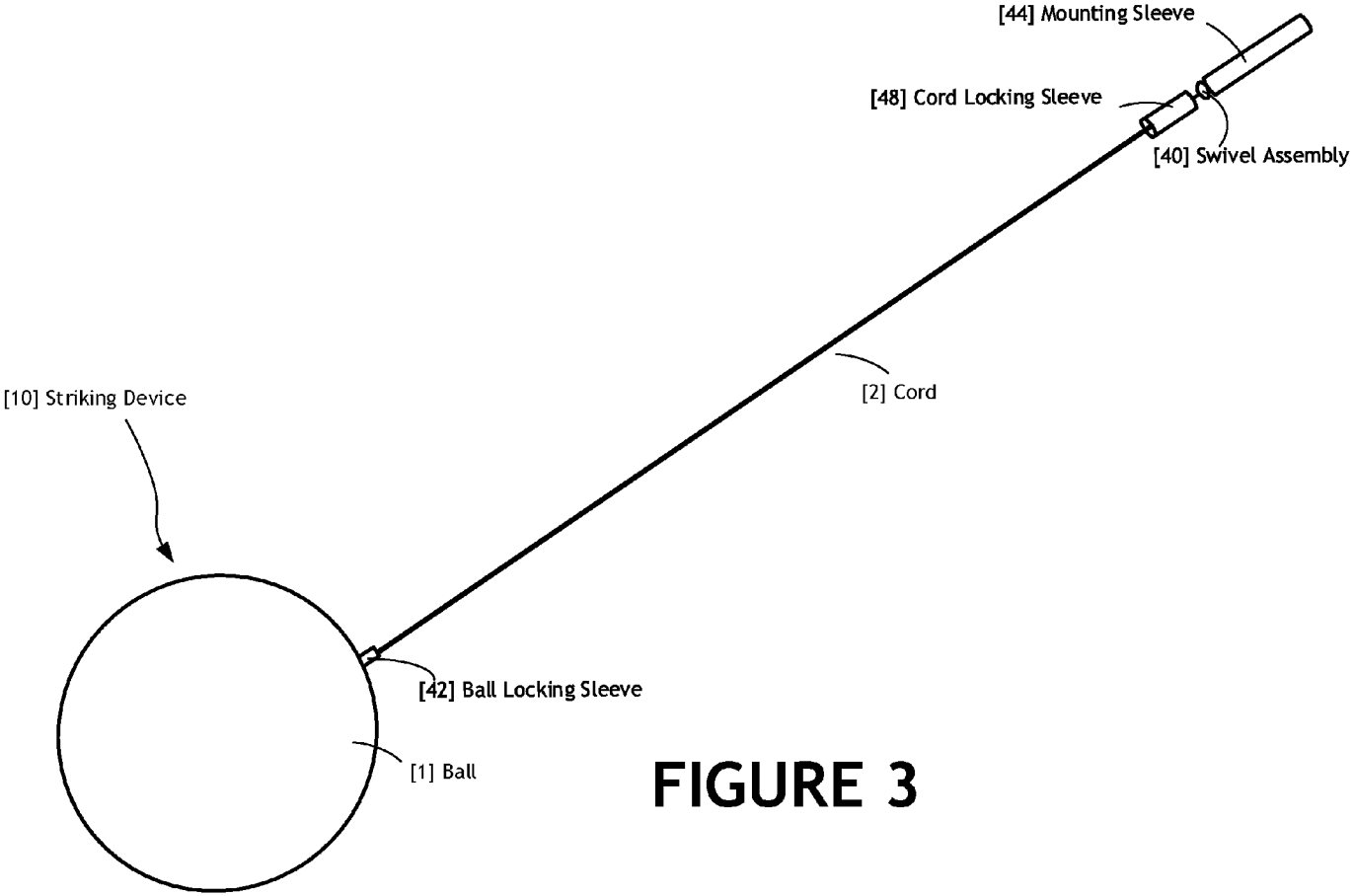
FIG. 3 depicts an assembled view of the preferred embodiment of the therapeutic striking and rehabilitation training system of FIG. 1.

FIG. 3 depicts the preferred embodiment of the therapeutic striking and rehabilitation training system [10] of the present invention assembled.

Figure 4B:
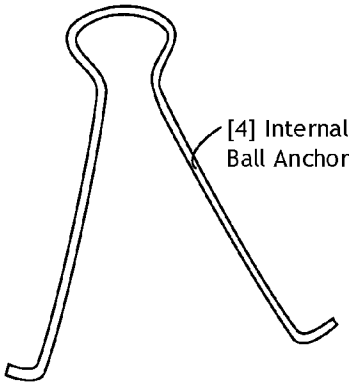
FIG. 4B depicts an detailed view of the of the internal ball anchor for the therapeutic striking and rehabilitation training system of FIG. 4A
Figure 4A:
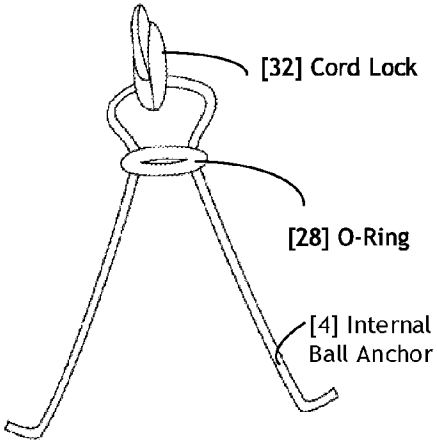
FIG. 4A depicts the individual components of the internal ball anchor/height adjustment assembly of the therapeutic striking and rehabilitation training system of the FIG. 1.
Figure 4C:
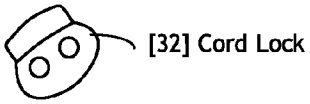
FIG. 4C depicts an enlarged view of the height adjustment lock for the therapeutic striking and rehabilitation training system of FIG. 4A.

FIG. 4A depicts the individual components of the internal ball anchor/height adjustment assembly of the therapeutic striking and rehabilitation training system of the present invention [10]. FIG. 4B depicts a detailed view of the internal ball anchor [4] of FIG. 4A. FIG. 4C depicts an enlarged view of the cord lock [32] of FIG. 4A.

Figure 5:
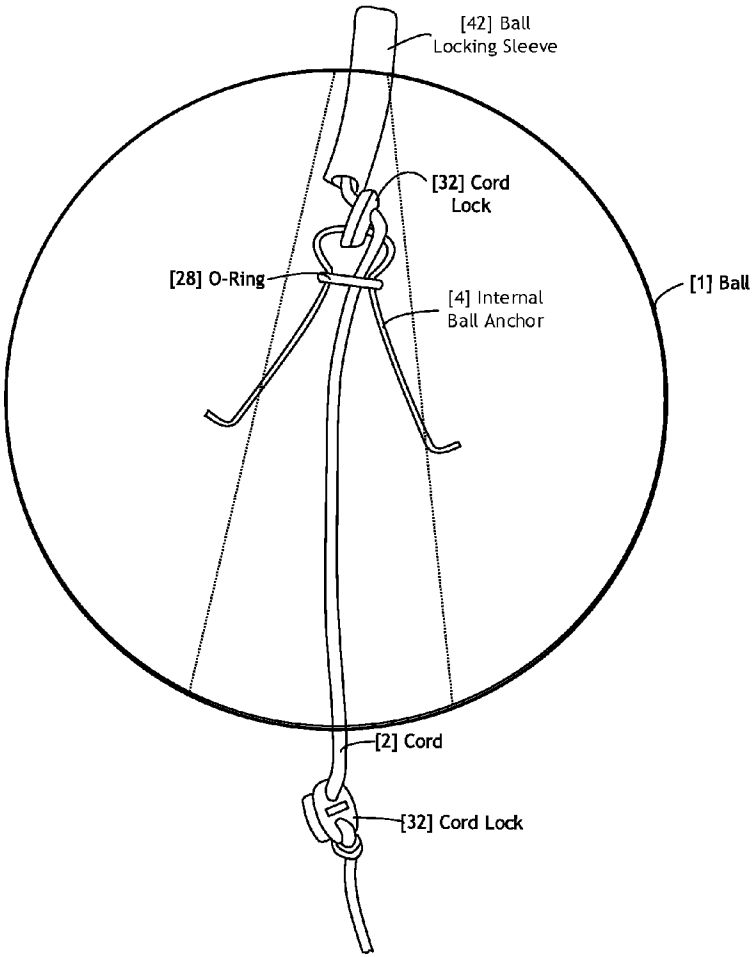
FIG. 5 depicts a first cutaway view of the ball height adjustment assembly the mounting of the preferred embodiment of the therapeutic striking and rehabilitation training system of FIG. 1.
Figure 6:
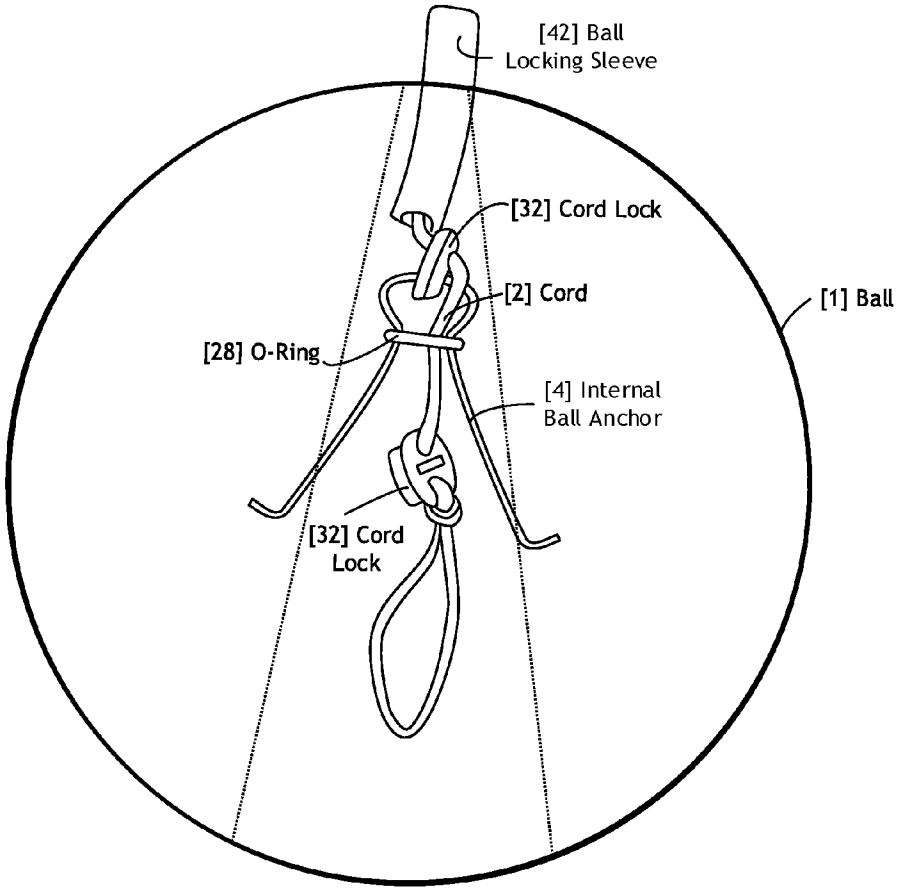
FIG. 6 depicts a second cutaway view of the ball height adjustment assembly of the therapeutic striking and rehabilitation training system of FIG. 1.

FIGS. 5 and 6 depict cutaway views of the height adjustment assembly [30] of the striking device [10]. In this particular embodiment, the internal ball anchor [4] is not tied to the cord [2]. The cord [2] passes through a rubber piece of tubing [42] and through a cord lock [32]. There are two holes in the cord lock [32], one of which the cord [2] pass through and the other through which the internal ball anchor [4] passes through. Near the top of the internal ball anchor [4] is an O-ring [28], which locates the cord [2] which passes through. Also, the O-ring [28] acts as a stop for the height adjustment lock. The O-ring [28] of choice is Model No. RO7, having an internal diameter of ⅜ in. I.D. and an outer diameter of 9/16 in. O.D.

To adjust the height of the striking device the user simply retrieves the loose end of the cord [2] located inside the bottom of the ball [1] applying sufficient downward tension to the cord [2] twist and slide upward the ball locking sleeve [42] about 12 inches. The ball [1] can now be slid up the cord [2] exposing the height adjustment lock [30]. The height adjustment lock [32] is then positioned approximately two inches below the desired ball height. Gently slide the ball [1] back down the cord [2] until the height adjustment lock [30] is securely seated inside the ball [1]. Excess cord [2] can be stored inside the ball [1] for future adjustments or carefully removed. Twist the ball locking sleeve [42] down into its seated position. FIG. 6 is a cutaway showing the bottom end of the cord [2] and the lower cord lock [32] tucked inside the ball [1] once the user completes height adjustment.

Figure 7C:
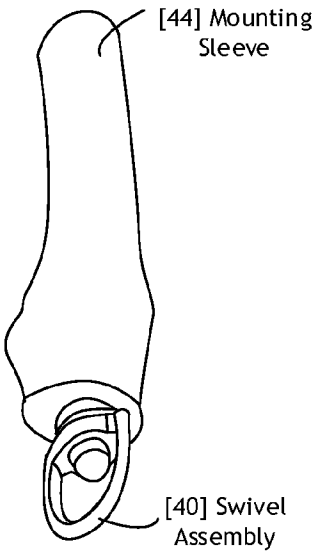
FIG. 7C depicted a detailed view of the preferred embodiment of the mounting sleeve pushed onto the swivel assembly of the therapeutic striking and rehabilitation training system of FIG. 7B.
Figure 7B:
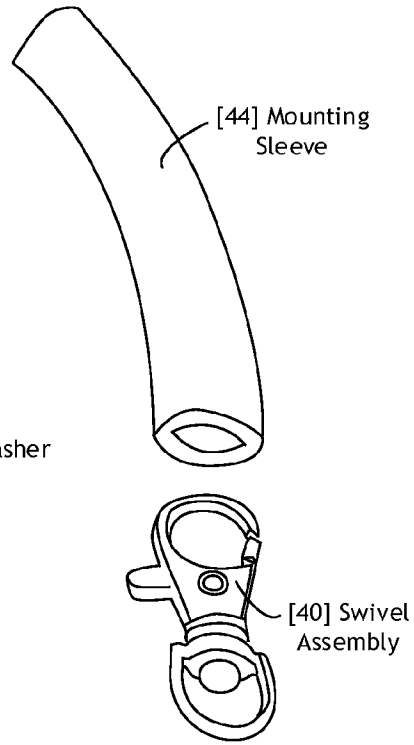
FIG. 7B depicts a detailed view of the preferred embodiment of the mounting sleeve and the swivel assembly of the therapeutic striking and rehabilitation training system of FIG. 1 unassembled.
Figure 7A:
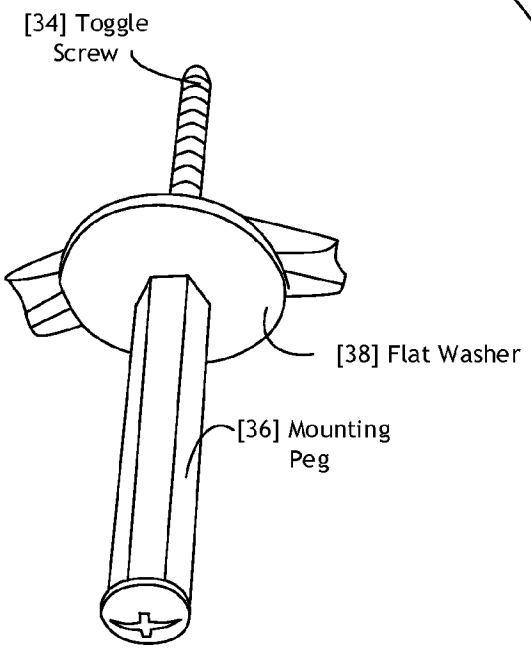
FIG. 7A depicts the toggle screw ceiling mount is shown assembled with a mounting peg, and flat washer for use with the therapeutic striking and rehabilitation training system of the preferred embodiment of FIG. 1.

FIG. 7A depicts the ceiling mount component of the therapeutic striking and rehabilitation training system of the present invention [10], wherein the toggle screw ceiling mount [34] is shown assembled with a mounting peg [36], and flat washer [38]. To use this mounting option, the user needs to drill a hole in the ceiling and then install the toggle [34] into the hole, and turn the toggle screw [34] until the toggle screw [34] grips the ceiling between itself and the washer [38]. The mounting peg [36] is also installed prior to the toggle screw [34] being inserted into the ceiling [20]. Once this is done, as is depicted in FIG. 7B, the mounting sleeve [44] can be pushed onto the mounting peg [36] and the swivel assembly [40] can be inserted into the mounting sleeve [44], as shown in FIG. 7C. The swivel assembly [40] can be inserted into the ball locking sleeve [42] prior to the mounting sleeve [44] being pushed onto the mounting peg [36].

Figure 8B:
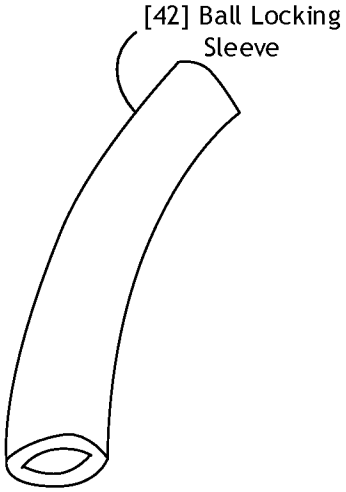
FIG. 8B depicts the dowel for the ball/cord locking sleeves of the therapeutic striking and rehabilitation training system of FIG. 8A.
Figure 8A:
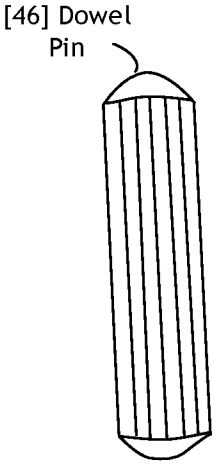
FIG. 8A depicts the ball/cord locking sleeves of the therapeutic striking and rehabilitation training system of the present invention.

FIG. 8A depicts the ball/cord locking sleeve [42/48] of the therapeutic striking and rehabilitation training system of the present invention [10]. FIG. 8B depicts the dowel pin [46] for the ball/cord locking sleeve [42/48] of the therapeutic striking and rehabilitation training system shown in FIG. 8A.

Off center strikes cause an unavoidable twisting action which can cause knotting and interruptions in therapy or play using of the therapeutic striking and rehabilitation training system of the present invention [10]. The swivel assembly [40] is designed to alleviate cord twist due to off center strikes. Also, the ball locking sleeve [42] is designed to restrict cord twist to the outside of the ball [1] protecting the height adjustment assembly from knotting.

The internal ball anchor [4] is a large binder clip handle. The cord lock [32] is preferably about 3.6 mm. The ball/cord locking sleeves [42/48] are preferably rubber tubing sized at 2 in.×⅜ in. I.D. with a ½ in. O.D. The wood dowel pins [46] are preferably wood and sized at ⅜ in.×1¼ in. The swivel assembly [40] is preferably a lobster clasp hook and sized at 1½ in.×½ in. The mounting sleeve [44] is preferably rubber tubing and sized at 3 in.×⅜ in. I.D. and having ½ in. O.D.

The ball anchor [4] is designed to randomly change the angle of the ball [1], changing the trajectory of the ball [1] after it has been struck. Thus, making the ball [1] more difficult to strike, forcing the user to alter the angle of attack, or to dodge the incoming ball and strike it after it has passed and is returning. This helps to build hand and eye coordination and is especially helpful to those with ailments, such as cerebral palsy, because it aids in strengthening the side of the body which is weaker than the other. It can also be used for rehabilitation after an injury to the shoulder or the arm in which the user has limited mobility and is in need of a way to regain flexibility as well as work on hand and eye coordination after the injury has healed. For those who have limited sight, such as a blind spot in one eye, this will aid in developing depth perception as well as hand and eye coordination.

To attach the therapeutic striking and rehabilitation training system the present invention [10] to the mounting peg [36], all a user need do is grasp the mounting sleeve [44] located at the end of the cord [2] and push the mounting sleeve [44] onto the mounting peg [36] with the whole apparatus being held via friction. When the user desires to remove the therapeutic striking and rehabilitation training system the present invention [10], the mounting sleeve [44] is carefully rolled back until the mounting sleeve [44] becomes unattached from the mounting peg [36].

When the ball [1] is struck, the ball [1] will swing away from the user and contact the ceiling [20], rebounding back to the user who can then hit the ball [1] again to send the ball [1] back up into the ceiling [20], or dodge the ball [1] and let the ball [1] pass and then strike the ball [1] as the ball [1] starts to swing back towards them again. Since the ball [1]

is suspended, the ball [1] will, at times, have a random trajectory depending on how the ball [1] is struck, forcing the user to constantly change their stance and either let the ball [1] pass them by dodging the ball [1], or striking the ball [1] as the ball [1] comes towards them. This helps the user develop hand and eye coordination as well as muscle coordination since the user will have to strike the ball [1] from different angles and positions as the trajectory of the ball varies.

Inconsistent accuracy when striking the ball results in less predictable rebounding requiring frequent adjustment of body position, punch selection, angle and force. The hand-eye quickly becomes the mind-body. The internal anchor [4] is designed to occasionally alter the angle of the rebound keeping even the most accurate user focused. Cerebral palsy patients and others who are left-right dominant can use the therapeutic striking and rehabilitation training system of the present invention [10] to strengthen the weaker side of their bodies physically and mentally. The ball [1] is preferably adjusted to hang at chin level. The ball [1] is then struck with the hand to begin a pendulum swing away from the user. As the ball [1] rebounds into range, the ball [1] can be struck repeatedly with one or both hands, either opened or closed, thus improving hand-eye coordination. The harder the ball is struck, the faster the rebound. Ball height, punch angle and rebound speed can all be adjusted by stepping closer to or farther away from the ball [1], during play without interruption. As coordination improves, the increase in consecutive strikes provides an excellent upper body aerobic exercise. Also, the user develops the ability to guide the ball [1] with one or two punches to set up another punch enabling the user to practice punch combinations. With attention to technical boxing and martial arts stances, balance and body mechanics while throwing punches, the benefits of this exercise can be felt from head to toe. When suspended from a ceiling [20] enabling 360 degree unfettered rebounding, the ball can be struck, ducked and struck from the opposite direction and back again without interruption improving defensive skills as well. The lightweight, soft uncoated foam ball absorbs the impact of both the strike and the rebound enabling soft-slower or hard-faster strikes providing an excellent workout for people at all levels of athleticism.

The additional advantages of the therapeutic striking and rehabilitation training system [10] of the present invention are that: (1) the soft and low impact material ensures safe and quiet fun and exercise; (2) a superior hand-eye coordination training device due to the unpredictable presentation; (3) always ready or can be set-up or taken down in a matter of seconds; (4) will hit back but while not hurting the user; (5) resilient rubber tubing relieves damaging downward pressure on the ball while adding momentum to the return position; (6) the striking device [10] mounts with one small hole and will not damage the ceiling; (20) the striking device [10] is tethered only from above, enabling the user to move beneath the target, providing superior defensive training, especially ducking and side stepping or barely evading, "slipping", strikes and kicks.

Those who are not injured can also use the therapeutic striking and rehabilitation training system of the present invention [10] to work on their hand and eye coordination. This is especially useful in situations in which one has limited space or lives in a setting, such as an apartment where engaging in a noisy workout is a distraction to neighbors or roommates. No matter how hard the ball [1] is struck, there is virtually no noise made and the system of the present invention [10] may be detached from the mount when not in use and stored away with only the mount protruding from the ceiling. In addition, with the system being light in weight, there is not any undue stress on the ceiling to which system of the present invention [10] is mounted and does not require heavy duty mounting, but only a small screw which will not make a large hole in the ceiling, later requiring a large repair. This is especially advantageous for those who dwell in apartments since most landlords will not require a payment for repairing small holes in the walls and ceilings.

The therapeutic striking and rehabilitation training system [10] of the present invention can even be used as part of a training competition where the competitors see how many consecutive repetitions each can do without missing.

The therapeutic striking and rehabilitation training system [10] of the present invention was not designed for any kicks or downward strikes. In addition, therapeutic striking and rehabilitation training system [10] of the present invention was not designed for use for bouncing and play with side walls. However, one having ordinary skill in the art will readily be able to apply the principles disclosed herein to design a striking device for use with a ceiling and side walls, and design a therapeutic striking and rehabilitation training system [10] of the present invention for use with jabs, hooks crosses, elbows, fore and backhand slaps, uppercuts and head butts.

All degrees of visual impairment can benefit from the hand-eye coordination training acquired by using the therapeutic striking and rehabilitation training system [10] of the present invention. Exercises such as "push and catch", "push and duck" or punching repeatedly, provide a safe, quiet and fun addition to any rehabilitation regimen or workout.

Also, the visually impaired can benefit from improved ability to visually track and contact moving objects using peripheral vision as opposed to the normally central vision connected coordination. With attention to peripheral visual tracking comes a noticeable decrease in depth perception, distortions in size, distance and speed. All of these perceptions are sharpened by using the therapeutic striking and rehabilitation training system [10] of the present invention.

Patients with neurological impairments may be able to improve left-right strength disparities while simultaneously improving hand-eye coordination left and right. Versatility enables use with an open hand or a tightly clenched first while also being an effective and healthy distraction from nuisance voluntary muscular spasms, cramps, twitches and discomfort.

In cases in which the inner ear has been damaged or destructively treated in order to control vertigo or tinnitus, patients are usually prescribed Cawthorne Cooksey exercises, which involve gradually training the brain to work around the loss of inner ear function for maintaining coordination and balance by having a person start to slowly practice every day movements; at first, the exercises have a person start with eye movements, up and down, left and right while sitting or lying in bed, then focusing on a finger moving one foot to three feet away from the face; Next, the person should move their head from side to side and up and down with the eyes close, first slow and then speeding up; while sitting, shoulder shrugging and circling, and bending over to pick up objects; while standing, all of the previous exercises with the addition of throwing a ball from hand to hand—above eye level—standing and sitting, throwing a ball from hand to hand under knee while sitting and changing from standing to sitting to turning around while standing and sitting. For more advanced exercises, the person is to circle around a someone while throwing a large ball back and forth; walk across a room with eyes open and closed, walk up and down stairs with eyes open and closed, and playing any game involving stooping, stretching and aiming. The present invention can be used in these last exercises.

The user can speed up or slow down the response time that the ball returns to the initial position by either shortening the distance or lengthening the distance that the user stands from the position that the tether is secured to the ceiling.

The exercise can be used similar to a speed bag in a boxing gym although it is a bit slower. The speed of the ball is also determined by the height of the ceiling, and the height of the user, a shorter cord resulting in faster and more skillful play. The user may also practice footwork by repositioning after striking the ball and by dodging the ball rather than striking the ball [1] rebounding from the ceiling surface.

If a different size ball [1] and different texture ball [1] are used, the therapeutic striking and rehabilitation training system of the present invention [10] can be used for kick training, batting practice, or paddle ball workout.

The therapeutic striking and rehabilitation training system of the present invention [10] also addresses the need for those individuals that are bedridden to exercise in bed. The utility improvements add to these exercises the ability to improve their mind, eye, hand and foot coordination while supine, seated, assisted, or standing and by one individually or with more than one person.

Throughout this application, various Patents and Applications are referenced by number and inventor. The disclosures of these documents in their entireties are hereby incorporated by reference into this specification in order to more fully describe the state of the art to which this invention pertains.

It is evident that many alternatives, modifications, and variations of the therapeutic striking and rehabilitation training system of the present invention will be apparent to those skilled in the art in light of the disclosure herein. For example, the system can be used for personal use as well as by personal trainers and those with ailments, such as cerebral palsy, to aid them in improving their coordination. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

1. Ball
2. Cord
4. Internal Ball Anchor
10. Striking Device
20. Ceiling
28. O-ring
32. Cord Lock
34. Toggle Screw
36. Mounting Peg
38. Flat Washer
40. Swivel Assembly
42. Ball Locking Sleeve
44. Mounting Sleeve
45. Center of Mass
46. Dowel Pin
48. Cord Locking Sleeve

I claim:

1. A therapeutic striking and rehabilitation training system comprising:

a. a tether having a length, a first end, and a second end;
b. a ceiling mount being cooperatively engageable with said first end, said first end being attachable to a ceiling surface via said ceiling mount;
c. a ball mount being cooperatively engageable with said second end of said tether, said tether being attached to an internal ball anchor including a cord lock, said cord lock being inserted internal to a ball locking sleeve, ensuring said internal ball anchor remains attached to said tether; and
d. a ball made of a spongy cellular material, said ball being attachable to said second end of said tether via said ball mount providing a tethered ball hanging from said ceiling surface, the length of said tether being adjustable enabling said ball mount to hang from said ceiling surface at an initial position enabling a user to engage in a full-body workout in a home environment;

whereby a punching action when said ball is struck with sufficient force propels said ball forward through a striking plane, said ball striking said ceiling surface, said ball rebounding from said ceiling surface with a rebounding action through a rebounding plane, said ball returning to said initial position for an instant enabling a repetition of said punching action and said rebounding action.

2. The system of claim 1, wherein said ball can be punched extremely hard, repeatedly, without damaging said home environment other than a hole in said ceiling surface for said ceiling mount.

3. The system of claim 1, wherein said system provides rehabilitation and therapeutic training in a home environment for persons with disabilities from an accident, wounded veterans, from disabilities involving birth defects, or as part of a physical therapy program.

4. The system of claim 1, wherein said ceiling mount includes a mounting peg.

5. The system of claim 1, wherein as said ball rebounds into said initial position for an instant, said user is enabled to punch said ball repeatedly with one or both hands.

6. The system of claim 1, wherein said user can adjust speed of said punching action and rebounding by moving nearer or farther away from said initial position of said ball.

7. The system of claim 1, wherein said ceiling mount includes a mounting sleeve and a mounting peg, said mounting peg being attachable to said ceiling surface.

8. The system of claim 1, wherein said internal anchor being of a design which randomly alters a rebound angle of said ball when said ball is struck.

9. The system of claim 1, wherein said system may be detached from said ceiling mount when not in use and stored away with only said ceiling mount protruding from said ceiling surface.

10. A therapeutic striking and rehabilitation training system comprising:

a. a tether having a length, a first end, and a second end;
b. a ceiling mount being cooperatively engageable with said first end of said tether, said first end of said tether being attachable to a ceiling surface via said ceiling mount, said ceiling mount including a mounting sleeve and a mounting peg, said mounting peg being attachable to said ceiling surface;
c. a ball mount being cooperatively engageable with said second end of said tether, said tether being attached to an internal ball anchor including a cord lock, said cord lock being inserted internal to a ball locking sleeve, ensuring said internal ball anchor remains attached to said tether; and d. a ball made of a spongy cellular material, said ball being attachable to said second end of said tether via said ball mount, said length of said tether being adjustable enabling said ball mount to hang from said ceiling surface at an initial position being generally positionable enabling said user to engage in a full-body workout in a home environment, without damaging said home environment other than a hole in said ceiling surface for said ceiling mount;

whereby a punching action when said ball is struck with sufficient force propels said ball forward through a striking plane, said ball striking said ceiling surface, said ball rebounding from said ceiling surface with a rebounding action through a rebounding plane, said ball returning to said initial position for an instant enabling a repetition of said punching action and said rebounding action.

11. The system of claim 10, wherein said ball can be punched extremely hard, repeatedly without damaging said home environment other than said hole in said ceiling surface for said ceiling mount.

12. The system of claim 10, wherein as said ball rebounds into said initial position for an instant, said user is enabled to strike said ball repeatedly with one or both hands.

13. The system of claim 10, wherein said internal anchor being of a design which randomly alters a rebound angle of said ball when said ball is struck.

14. The system of claim 10, wherein said system may be detached from said ceiling mount when not in use and stored away with only said ceiling mount protruding from said ceiling surface.

* * * * *